United States Patent [19]

Goncalves

[11] 4,143,431

[45] Mar. 13, 1979

[54] SUPPORT FOR HOLDING A WATER-SOLUBLE STICK FOR TOILET BOWLS

[75] Inventor: Antonin Goncalves, Groslay, France

[73] Assignee: L' Oreal, Paris, France

[21] Appl. No.: 703,361

[22] Filed: Jul. 8, 1976

[30] Foreign Application Priority Data

Jul. 9, 1975 [FR] France ..... 75 21570
Nov. 25, 1975 [FR] France ..... 75 35954

[51] Int. Cl.[2] ..... E03D 9/02; B05D 83/00; A61L 3/00

[52] U.S. Cl. ..... 4/231; 220/18.1; 220/87; 220/94 A; 248/360; D23/150

[58] Field of Search ..... 4/107, 222, 223, 227, 4/228, 231, 291, 294; 220/95, 96, 94 A, 87; D23/150; 248/96, 166, 168, 360; 220/18.1

[56] References Cited

U.S. PATENT DOCUMENTS

| | | | |
|---|---|---|---|
| D. 192,314 | 3/1962 | Brownstein | D23/150 |
| D. 243,850 | 3/1977 | Davenport | D23/150 |
| 1,693,889 | 12/1928 | Dick | 248/96 |
| 2,051,940 | 8/1936 | Chichester-Miles | 220/94 A |
| 2,866,575 | 12/1958 | Lattuca | 220/94 A |
| 2,937,783 | 5/1960 | Press et al. | 220/94 A |
| 3,088,126 | 5/1963 | Klinger | 4/231 |
| 3,163,338 | 12/1964 | Gottsegen | 220/95 X |

FOREIGN PATENT DOCUMENTS

| | | | |
|---|---|---|---|
| 2200414 | 4/1974 | France | 4/231 |
| 1164141 | 9/1969 | United Kingdom | 4/231 |

OTHER PUBLICATIONS

Research Disclosure, Feb. 1974, No. 118, p. 5.

*Primary Examiner*—Stuart S. Levy
*Attorney, Agent, or Firm*—Brisebois & Kruger

[57] ABSTRACT

A support basket for holding a water soluble stick for toilet bowls. The support basket has two concave portions hinged to close against each other to form the basket. Hooks are hinged to the basket for mounting the basket on a toilet bowl. Each hook has a curved profile and is elastically deformable to enable the hook to conform to toilet rims of different thickness.

12 Claims, 11 Drawing Figures

SUPPORT FOR HOLDING A WATER-SOLUBLE STICK FOR TOILET BOWLS

One knows that to assure the disinfection, sanitation and deodorization of toilet bowls one uses blocks of hydrosoluble products which are placed inside a perforated basket forming a receptacle, this basket being, in general, suspended from the edge of the toilet bowl by means of an associated hook which the user has previously attached to the basket.

However, in order to avoid any risk of unhooking the receptacle which is destined to be eroded by the flushing water and to simplify the task of the user in the course of putting it in place, one has already proposed to manufacture supports for hydrosoluble products composed of a basket fixed to a suspension hook, which is most often obtained by moulding with said basket. Moreover, in order to reduce the bulk of the basket-suspension hook assembly before usage, one has also proposed to connect the suspension hook to the basket by a flexible attachment which permits it to occupy a folded position. This arrangement restricts the volume of the package into which the basket with the attached suspension hook which contains the hydrosoluble bar may be introduced with a view to its commercialization. As advantageous as this known packaging method may be, especially because it avoids any operation of mounting on the part of the user at the moment of placing in use, it nevertheless retains the disadvantage that its receptacle is generally made in two independent parts capable of being attached to each other after having introduced the block of deodorizing product thereinto. It is thus indispensable in this case to proceed to the moulding of at least two separate members, which complicates the manufacture of the support and renders it relatively expensive.

The present invention has for a purpose to remedy the said inconveniences and, to this end, proposes to make a basket having an attached and foldable hook, said assembly being advantageously made in a single moulding step from plastic material.

The present invention thus has for object the new industrial product of a support comprising a perforated basket forming a receptacle destined especially to contain a product of hydrosoluble material for the disinfection and deodorization of toilet bowls, said basket being constituted of two substantially identical parts in the form of concave members, coming in contact with each other along their peripheral edges, one concave member being pivotally attached to the other concave member along an axis parallel to the axis of the basket, by means of at least one attachment formed by moulding it with said concave members, said attachment connecting the two concave members along one of the longitudinal edges, the two concave members being equally capable of being attached to each other along their other longitudinal edge to insure the closure of the basket, the basket being, moreover, associated with at least one suspension hook in the form of a U, characterized by the fact that the basket is fixed to one or more suspension hooks formed by moulding with said basket, the suspension hook or hooks being pivotally attached transversely with respect to the axis of the basket by means of a web hinge, in a fashion such that the branch of the U of the hook which is connected to the basket may come opposite the lateral longitudinal surface of the basket after its closure.

In a preferred embodiment of the invention, the basket is generally cylindrical in shape, each of the two concave members which constitute it having a transverse semi-circular section; the two concave members pivoting with respect to each other by means of a plurality of web hinges regularly spaced along the length of the basket; the one of the longitudinal edges of a concave member which serves to close the basket having a projection positioned radially with respect to said concave member and comprising in its central zone a recess inside which snaps a corresponding cylindrical member formed on the one of the longitudinal edges of the other concave member which is destined to bear against said projection upon closure of the basket; the suspension hook or hooks comprise an end part in the form of a U serving to assure the hooking of the basket on the edge of a toilet bowl; the central branch of the U of the hook may advantageously have longitudinally a curved profile, said branch being then elastically deformable.

It will be conceived that the fact of making the assembly (basket-suspension hook) in a single step of moulding from plastic material makes it possible to obtain at a low cost a one-piece support for a hydrosoluble product. This method of packaging also avoids the presence of a hook which is not in one piece therewith which it would otherwise be necessary to mount on the basket at the moment that it is put in place.

In the course of its use, the support according to the invention produces a very efficaceous support of the receptacle under the flushing water without any disassociation being produced between the suspension hook or hooks and the basket, since the assembly is made in a single piece.

It is clear that the attaching means in the form of a web hinge of the suspension hook or hooks for at least one of the concave members constituting the basket may be positioned on any peripheral zone of this concave member. However, for the questions of bulk of support, before use, it is desirable to position the suspension hooks in a fashion such that the volume defined by the basket and its folded hooks is substantially identical to the one occupied by the basket alone, which makes it possible to place the support containing the hydrosoluble product in a package of restricted dimensions.

It is also known that one of the problems posed by the attachment of the supports of the hydrosoluble product on the interior wall of toilet bowls is that the thickness of the edges of the bowls on which the suspension hooks are hooked may be variable in dimension. This problem is resolved by providing hooks in which the central branch of the U is elastically deformable, having a longitudinal profile which is an arc of a circle: the user by elongating the center of the U of the hook, that is to say, by increasing its radius of curvature, may also adjust the hook to the thickness of the edge of the bowl to which it is desired to suspend the support; moreover, thanks to the elasticity of the central branch of the U, each hook serves as gripping means and consequently assures efficaceous maintenance of the support for the hydrosoluble product on the bowl.

In a first variation of the invention the support according to the invention comprises only a suspension hook which pivots about an axis perpendicular to the axis of the basket by means of a web hinge positioned on one of the two concave members substantially in the transverse median plane of said concave member. In a second variation, one of the two concave members is fixed to two suspension hooks which pivot transversely with respect to the axis of the concave member by means of a web hinge; the two web hinges are advantageously positioned at each end of the radial projection which constitutes the longitudinal edge of the concave member serving to assure closure of the basket.

In a third variation, each of the two concave members is fixed to a suspension hook which pivots transversely with respect to the axis of said concave member by means of a web hinge; the web hinges are advantageously positioned at the opposite end of the concave members symmetrically with respect to the central point of the generatrix along which the two concave members pivot.

In a first embodiment of the second or third variation, the branch of greatest length of each suspension hook is greater than the length of the basket, the central branch of the U of each hook being destined to come in folded position, opposite the transverse end face which is opposite that where the hook is connected, the two branches of greatest length being then brought toward each other and positioned on opposite sides of the closure zone of the basket; the transverse end face of a concave member opposite the one which is destined to become the central branch of the U of the hook, comprises, in its median zone and at its periphery, a stud formed by moulding which extends parallel to the axis of the basket, said stud serving to hold the corresponding hook in folded position.

In a second embodiment of the second and third variations, in which the central branch of the U of the two suspension hooks which comprise the support have a curved profile, the two hooks are capable of pivoting about their web hinge in a fashion such that their two longest arms may abut each other, substantially against the longitudinal edge of the concave member diametrically opposed to the generatrix along which the two concave members pivot, the central branch of the U of each hook then coming to mate with the lateral longitudinal surface of a concave member, after closure of the basket.

This second embodiment of the support having two adjacent hooks has a particular value; since the central branch of the U of each hook perfectly matches the contour of the receptacle in the closed positon, it results that the one piece support occupies during storage a volume which is practically no larger than that of the receptacle alone. Moreover, in the position of use, the two unfolded hooks may adapt themselves to all thicknesses of the edge of the toilet bowl as has already been indicated.

In a third embodiment of the second or third variation above mentioned, one improves the hooking of the support by providing for the assembly in the position of use of the two extreme branches of the two hooks so as to produce a double extensible hook adapted to all models of bowls. The support according to this embodiment is characterized by the fact that the two extreme branches of the U of the hook which are not connected to the basket comprise means permitting them to be attached to each other after having unfolded the two hooks. One prefers that the attachement is effectuated in a position in which the two central branches of the U of the hook have their concavities turned toward each other, the branches of the two hooks which are connected to the basket being positioned on opposite sides of the two attached extreme branches; the attachment may advantageously be effectuated by snap fitting.

One may advantageously, to produce the third embodiment of the second and third variations such as above defined, act so that the two supporting hooks are identical, each extreme branch of the U of the hook consisting of an elongated plate, the two plates being susceptible, by deformation of the central branch of each of the U-shaped hooks, of being applied against each other, in a plane of assembly perpendicular to the axis of the basket, to assure the attachment of the two extreme arms; the means permitting the attachment of two extreme arms of the U of the two hooks are snap fastening means consisting, on the one hand, of at least one projection formed on the extreme branch of one of the hooks and, on the other hand, at least one corresponding hole formed in the extreme branch of the other hook; each central branch of the U of the hook presents longitudinally a substantially semi-circular profile; the two branches of the U of the hook which are connected to the basket have a length approximating that of the basket. The two hooks are capable of pivoting about their web hinge so that their branches, which are connected to the basket, may fall back against each other substantially against the longitudinal edges of the two concave members, along which the closing of the basket is effected, the central branch of the U of each hook coming then, after closure of the basket, to mate with the lateral longitudinal surface of one of the concave members.

The support according to the invention is destined to enclose previously moulded blocks of a hydrosoluble product which one desires to progressively dissolve in the flushing water of a toilet bowl. For this purpose one positions, in use, the moulded block inside the basket and after having operated the closure of the basket as well as the folding of the hooks, one may store the assembly in a vapor proof package for commercial exploitation. At the moment of use, the user tears the sealed package and suspends without difficulty the basket by its hooks. It is even possible to commercially distribute separately the support according to the invention and the moulded hydrosoluble product by then leaving to the user the introduction of the block of deodorizing and disinfectant product into the basket. A third known technique described in particular in French application No. 74-02052 filed in the name of the applicant, now French Pat. No. 2,258,320, consists in pouring in place the hydrosoluble product in a supporting cage inside of which one has first positioned a cylindrical bag. This bag advantageously consists of a film of polyvinyl alcohol highly soluble in water; after pouring and solidification of the hydrosoluble product in the said bag, one closes the receptacle and places it in a storage bag. This method leads to various advantages; the envelope of polyvinyl alcohol is sufficiently vapor proof so that there is no evaporation of the active product during storage; moreover, the film of polyvinyl alcohol prevents any contact between the hydrosoluble product moulded in situ and the fingers of the user at the moment it is placed in the assembly.

The present invention also proposes to provide a one piece support which permits the in situ moulding of a block of hydrosoluble product. The present invention has thus for object the new industrial product which consists of an assembly formed by a hydrosoluble product destined to dissolve in the flushing water of a toilet bowl and a support such as the one above described characterized by the fact that, on the one hand, one of the transverse end faces of a concave member delimits with the corresponding transverse end face of the other concave member upon closure of the basket, a wall inside which is formed at least one orifice and that, on the other hand, the hydrosoluble product is enveloped, at the outside of the closed basket in which it is placed, by at least one hydrosoluble film stretched around the adjacent zone of said basket.

In a preferred embodiment, the orifice is substantially circular and positioned along the axis of the basket, a collar being connected to the edge of said orifice and projecting with respect to said basket; the film which envelopes from the outside the basket containing the hydrosoluble product is made of polyvinyl alcohol.

The present invention has finally for object a new method of storing the hydrosoluble product destined to dissolve progressively in the flushing water of a toilet bowl, said process utilizing a support such as the one above described, characterized by the fact that in the first place one positions inside the basket the support previously closed and all around the perforated zone thereof a contractable hydrosoluble film, this film not covering the orifice formed in the wall of the end of the basket; that in the second place one stretches the film over the perforated zone of the basket; that in the third place one pours the hydrosoluble product heated to the liquid state into the basket; and that finally, after solidification of the product poured in place, one eventually locates the assembly (support-hydrosoluble product) thus produced inside a package, the suspension hook or hooks adjoining being first folded back.

This process of storage may be used for all compositions of hydrosoluble product, for example that mentioned in patent application No. 74-02052 above mentioned.

In the case of the third embodiment of the second and third variations, the user, at the moment of use, tears the sealed package in which the support holding a bar of active product is enclosed, and folds out the hooks so that the longest branches are substantially parallel and perpendicular to the axis of the basket; then he drops the two extreme branches of the hook to snap fasten them, the two hooks thus connected being then put in place on the edge of the toilet bowl. Since the central branches of the two hooks are deformable, the support may be suspended without difficulty on all models of bowls regardless of the thickness of the edge of said bowls. Moreover, the central branches, by reason of their conjugate elasticities, assure an efficaceous gripping of the two extreme snap fastening branches on the one hand and the two longer branches on the other hand, against the wall of the bowl from which the support is suspended, while avoiding any risk of swinging of the support at the moment of the spraying by the flushing water.

In order that the object of the invention may be better understood, one will hereafter describe by way of purely illustrative and non-limiting examples, several embodiments represented on the attached drawing. On this drawing.

Figure 1:
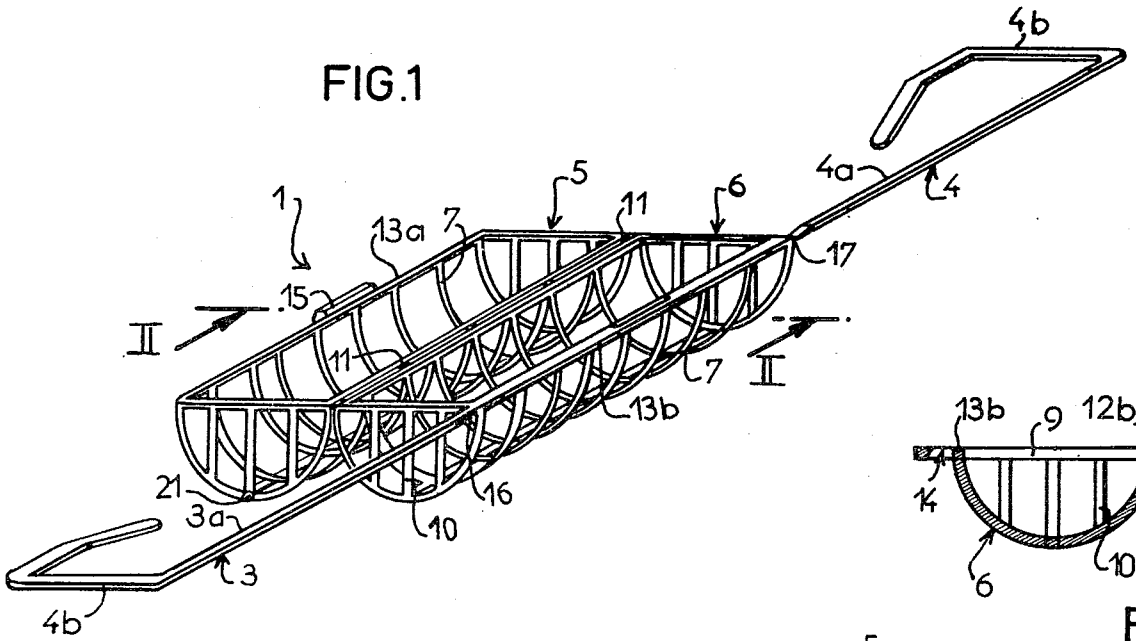
FIG. 1 represents in perspective a support consisting of a basket having two associated hooks for the holding of a hydrosoluble bar in a toilet bowl, this basket made in two parts in the form of concave members pivotally attached to each other being in open position.

Referring to FIGS. 1 to 5 of the drawing, one sees that one has designated by numeral 1 in its assembly, a one-piece support for holding a hydrosoluble bar which one desires to progressively dissolve the flushing water of a toilet bowl in order to especially assure its disinfection and its deodorization. This support 1 comprises a basket 2 forming a receptacle and two associated suspension hooks 3 and 4.

The cylindrical basket 2 inside which is lodged the bar of active product, is made in two parts 5 and 6, substantially identical, in the form of a hollow member. Each hollow member is perforated, has a transverse semi-circular section, and is composed of a plurality of half rings 7 coaxially disposed along the axis of the basket 2 and regularly spaced from each other. The half rings 7 are connected to each other in their median zone by a longitudinal bar 8 parallel to the axis of the basket and at their ends by a peripheral rectangular rib situated in the longitudinal median plane of the basket. Each transverse end face of the concave members 5 and 6 is formed from an end half ring 7 and a transverse branch 9 of the peripheral rib between which are connected parallel bars 10.

The two concave members 5 and 6 are assembled by their peripheral ribs which contact each other in the longitudinal median plane of the basket 2. An essential characteristic of this support 1 resides in the fact that, instead of being independent the two concave members 5 and 6 are pivotally attached by means of connectors 11 formed by moulding with said concave members. Each connector 11 consists of a web hinge connecting the two concave members by their longitudinal edges 12*a* and 12*b* formed along a generatrix of the cylindrical basket. In this embodiment the pivotal attachment of the concave member 5 relative to the concave member 6 and vice versa is effectuated along a pivotal axis parallel to the axis of the basket 2 by five connectors 11. These connectors 11 are positioned at regular intervals along the basket and each extend between two half rings 7 positioned in the same perpendicular plane as the axis of the basket.

The attachment of the two concave members 5 and 6 is effectuated by their two other longitudinal edges 13*a*, 13*b* respectively positioned along one of the generatrices of the cylindrical basket 2 and diametrically opposite to the pivotal axis of the two concave members. The longitudinal edge 13*b* which the concave member 6 comprises, defines a projection positioned radially with respect to that concave member and extending the full length thereof. A rectangular recess 14 is formed in the median zone of the edge 13*b*. The two edges which longitudinally delimit this recess are substantially convergent in a direction perpendicular to the diametral connecting plane of the two concave members, as is clearly visible on FIG. 2. On the longitudinal edge 13*a* of the other gutter 5 is formed a snap fastening rib 15 complementary to the recess 14. Thus, upon closing of the basket 2, the two concave members may be fastened to each other by snapping the rib 15 into the recess 14.

The two suspension hooks 3 and 4 are connected to each of the ends of the edge 13*b* formed on the concave member 6 by a web hinge 16, 17. The web hinges 16 and 17 are both constituted by a weakening in the wall of the longer arm 3*a*, 4*a* of the suspension hooks. Each web hinge is positioned on a slight projection of the edge 13*b* with respect to the corresponding transverse end face of the concave member 6. Each suspension hook is capable of pivoting about its web hinge along an axis extending radially with respect to the basket 2. The two suspension hooks 3 and 4 comprise, in a conventional manner, an extreme part in the form of a U adapted to permit the hooking of the basket 2 on the edge of a toilet bowl. It is to be noted that the branches 3*a* and 4*a* of the hooks have a lengh slightly greater than that of the basket 2.

The support 1 which has just been described has the advantage that it may be made in a single moulding step from a plastic material such as polypropylene for example.

The bar of active product, which is destined to be dissolved in the flushing water of a toilet bowl, is easily introduced into the open basket 2. In the open position of the basket the two hooks 3 and 4 are deployed on opposite sides of the basket 2 so that they do not interfere with the introduction of the hydrosoluble bar. To operate the closure of the basket 2, one of the concave members is pivoted with respect to the other, they are then attached to each other by snapping the ridge 15 into the recess 14. The one piece support 1 then occupies the position represented in FIG. 3.

To avoid that, before use, the basket 2 and its two associated hooks 3 and 4 do not constitute a voluminous assembly necessitating a large package, the hook 4 may be turned about its web hinge 17 as indicated by the arrow 18 until the central zone 4*b* of the U is opposite the end face of the concave member 5. One operates in accordance with the same process with the hook 3 which is pivoted around its hinge 16 in the direction indicated by the arrow 19 until the central zone 3*b* of the U of the hook is in alignment with the end face of the concave member 6 which is opposite the one to which the hook 3 is connected.

Figure 4:
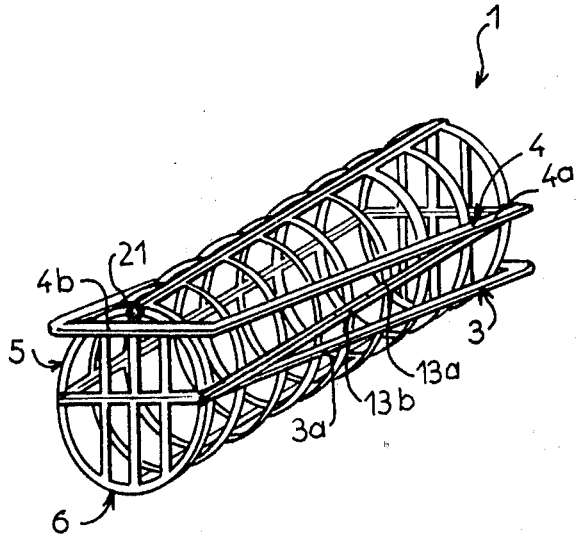
FIG. 4 represents, in perspective, the support of FIG. 3, the two hooks being in folded position for storage.

The support 1 having its hooks in folded position is represented on FIG. 4. One observes that the branches 3*a*, 4*a* of the hooks are brought toward each other and positioned on opposite sides of the closure zone 13*a*, 13*b* of the basket 2. The two transverse end faces opposite which the central branches 3*b* and 4*b* of the U of the hooks are located, each comprise, in their median zone and at their periphery, a projection 20, 21. These two projections 20, 21 serve to assure the maintenance of the hooks in folded position. It will be understood that before use, the two hooks being folded, the one-piece support 1 occupies a volume which is practically no greater than that of the basket 2 alone.

Figure 5:
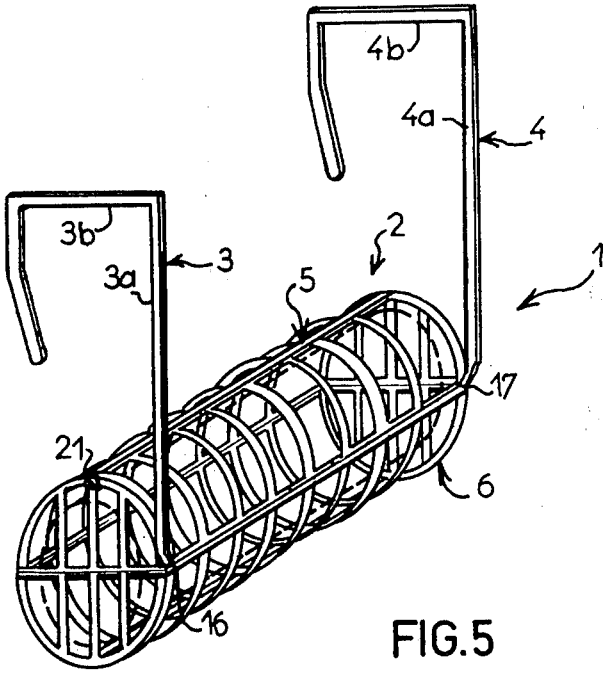
FIG. 5 represents in perspective the support of FIG. 3 in which the two hooks are in the active deployed position corresponding to the moment at which it is put in place on the edge of a toilet bowl.

At the moment of use the user separates the two hooks from each other until their branches 3*a* and 4*a* are substantially parallel and perpendicular to the axis of the basket 2 as indicated in FIG. 5. It then suffices for the user to seize the support 1 by its two hooks 3 and 4 and mount them on the edge of the toilet bowl.

Figure 7:
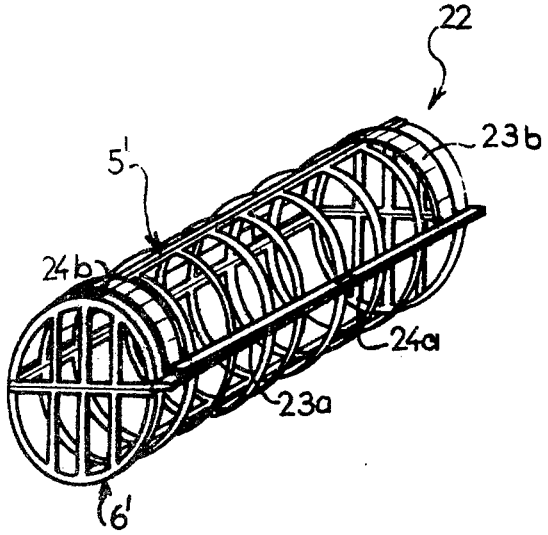
FIG. 7 represents the support of FIG. 6, the two hooks being folded.
Figure 6:
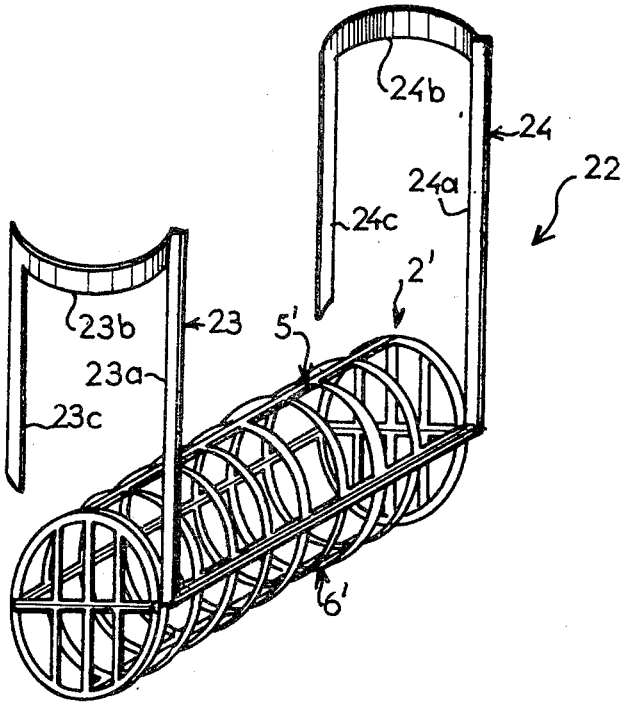
FIG. 6 shows in perspective, a variation of the embodiment of FIGS. 1 to 5 in which the central zone of the U of each hook has a curved profile, the two hooks being shown in position of use.

Referring now to FIGS. 6 and 7 it will be seen that one there finds substantially all the elements described for the embodiment of FIGS. 1 to 5, only the two foldable suspension hooks being of different configuration; in other words, the two hooks identified by reference numerals 3 and 4 in the embodiment of FIGS. 1 to 5 are modified while all the other constituent elements of the basket of FIGS. 1 to 5 remain identical in the embodiment of FIGS. 6 and 7. On FIGS. 6 and 7 one has in consequence applied to the constituent elements of the basket the same reference numerals completed by the prime mark, only the suspenion hooks of a different structure having been differently numbered.

One thus finds a one-piece support designated by 22 in its assembly, comprising a perforated basket 2′ forming a receptacle. The basket 2′ is constituted by two concave members 5′ and 6′ having a semi-circular transverse section. The two concave members 5′ and 6′ pivot relatively to each other by means of moulded connectors which are positioned between two longitudinal edges. At the closing of the basket 2′ the attachment of the two concave members 5′ and 6′ is effectuated by snapping the length of the generatrix diametrically opposed to the one which effectuates pivotal movement.

Two suspension hooks 23 and 24 pivot transversely with respect to the axis of the basket 2′, by means of a web hinge positioned at each end of the snap fitting edge of the concave member 6′. The two web hinges are obtained by forming a weakened area in a wall of the branch 23*a*, 24*a*, of greater length, of the two hooks. The two branches 23*a* and 24*a* have a length substantially equal to that of the basket 2′. The two hooks terminate in a part having a U shape constituted by a central curved branch 23*b*, 24*b*, to the two ends of which are respectively connected the branches 23*a* and 23*c* on the one hand, 24*a* and 24*c* on the other hand. The particularly of these two hooks is that the central branch of the U of the hook has a substantially semi-circular longitudinal profile.

On FIG. 6 one has represented the support in position of use, that is to say, with its two hooks substantially parallel positioned perpendicularly to the axis of the basket 2′. In this position the central branches 23*b*, 24*b* have their concavities turned toward each other. To position the hook on the edge of a toilet bowl, regardless of the thickness thereof, the user deforms the curved profile so as to separate the two arms 23*a*, 23*c*, or 24*a*, 24*c* from each other and places the hook on the edge of the bowl. After having forked the U of each hook on the edge of the bowl, the central branch of the U, forming a spring, tends to regain its curved original profile and thus assures gripping of the two parallel branches against the edge of the toilet bowl.

The two suspension hooks 23 and 24 are capable of falling toward each other in a common direction like the branches of a pair of spectacles, to occupy the position shown in FIG. 7. In this position the two longest branches 23*a*, 24*a* are positioned one on the other against the snapping edge; the two central branches of the U then fit the semi-circular contour of the concave member 5'.

The value of this embodiment is to obtain a support 22 having two associated hooks presenting, in storage position, a bulk substantially equivalent to that of the basket 2 alone, and capable of being suspended in toilet bowls regardless of the thickness of the edge of the bowl.

Figure 8:
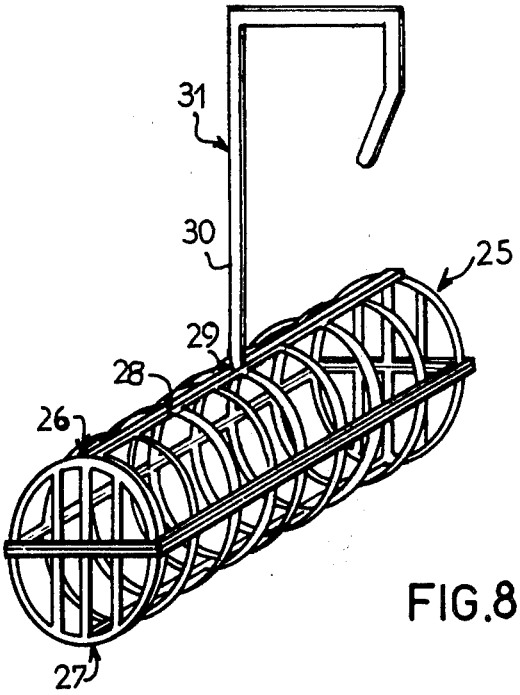
FIG. 8 represents in perspective a support which comprises only one associated foldable hook, the hook being in position for use.

On FIG. 8 one has shown another variation of the support according to the invention. In this variation the cylindrical basket designated by 25 in its assembly consists of two pivoted concave members 26 and 27 identical to the concave members 5 and 6 of FIGS. 1 to 5. The longitudinal bar 28 which the concave member 26 comprises a fixed, at its central part, to a connector consisting of a web hinge 29 which connects to the concave member 26, the longer arm 30 of the suspension hook designated by 31 as a whole. The hook 31 pivots with respect to the basket 25 thanks to its web hinge 29 which constitutes a pivotal axis positioned substantially perpendicular to the axis of the basket 25. This web hinge makes it possible to fold the hook 31 so that its longest branch is substantially parallel to the axis of the basket 25 during storage, which also makes it possible to have a one piece support of reduced bulk.

Figure 9:
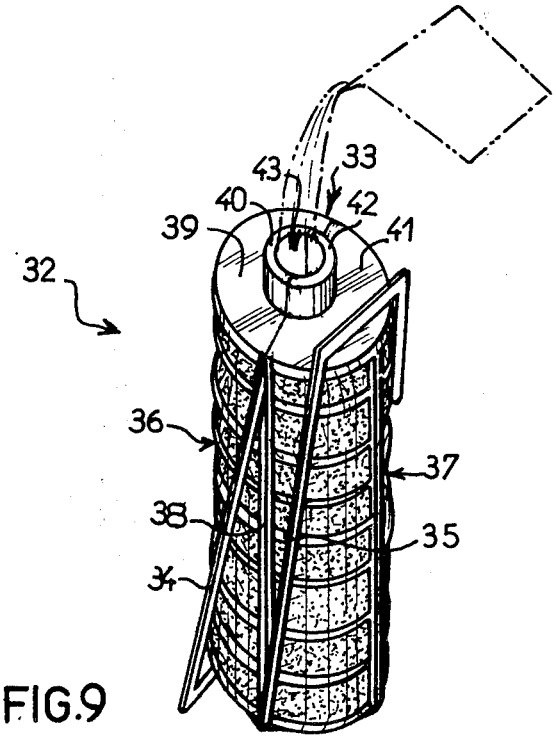
FIG. 9 represents in perspective, a support destined to contain a block of hydrosoluble product moulded in situ in the closed basket.

Referring to FIG. 9, one sees that one has represented a one-piece support designated by 32 in its assembly, the support 32 comprising a cylindrical basket 33 and two suspension hooks 34 and 35 formed by moulding with said basket. The support is substantially identical to the embodiment shown in FIGS. 1 to 5 in the sense that the basket 33 consists of two concave members 36 and 37 which pivot with respect to each other about a pivotal axis parallel to the axis of the basket 33 by means of web hinges. At the closing of the basket, the two concave members may also be attached to each other by the snap fitting of a rib into a corresponding recess formed in the longitudinal edge 38 of the concave member 36. At the two ends of the edge 38 are connected, by means of a web hinge, two suspension hooks 34 and 35 analogous to those described in the embodiments of FIGS. 1 to 5. The two hooks pivot transversely with respect to the axis of the basket in a fashion to occupy, when they are folded, the same position which is represented in FIG. 4.

A transverse end face of the concave member 36 is formed from a plate 39 in the form of a half ring. Around the semi-circular interior edge of the plate 39 is connected at right angles a collar 40 which has, in section, the shape of a semi-circle extending to the outside of the concave member 36. The corresponding end face of the concave member 37 also consists of a plate 41 to which is attached a semi-circular collar 42. In closing the basket 33 the two plates 39 and 41 as well as the collars 40 and 42 come edge to edge as is well visible on FIG. 9. The two collars 40 and 42 then form a neck 43 situated in the axis of the basket.

The hydrosoluble active product which one desires to place in the support 32 is moulded directly in situ in the closed basket 33. To do this one surrounds the perforated zone of the closed basket 33 with a contractable hydrosoluble film while leaving the neck 43 free. The contractable film is schematically indicated on the drawing by the fine lines; it is made of polypropylene. One then contracts the film to stretch it over the perforated structure of the basket 33. The basket 33 which envelops the film defines an inner volume communicating with the outside through its neck 43.

The active hydrosoluble product which one desires to introduce into the basket has the following composition by weight:

| | |
|---|---|
| Detergent | 19% |
| Paradichlorobenzene | 80% |
| Perfume | 1% |

After having brought the active product to a temperature between 65° and 75° C. so as to render it liquid, one pours it into the basket 33 through the neck 43. One stops filling when the level of the liquid product reaches substantially to the base of the neck 43.

After solidification, one obtains a bar of hydrosoluble product closely matching the interior volume of the basket 33 and moulded onto the bars constituting the concave members so that the bar cannot budge with respect to said basket. It is possible, if one so desires, to close the neck 43 of the basket 33 in order to sealingly isolate the stick of hydrosoluble moulded product with respect to the external atmosphere.

The assembly (support 32- hydrosoluble product), ready for use, may then be stored in a packaging box after having suitably folded the two associated hooks 34 and 35. At the moment of use, the user unfolds the two hooks 34 and 35 and suspends the support by seating the hooks on the edge of the toilet bowl. Since the bar of moulded product is covered by a hydrosoluble film, the user may put the support 32 in place without having his fingers touch the moulded bar. During use, the flushing water dissolves the hydrosoluble film enveloping the cage and the moulded bar may then exert its disinfecting and deodorizing action on the toilet bowl.

Figure 10:
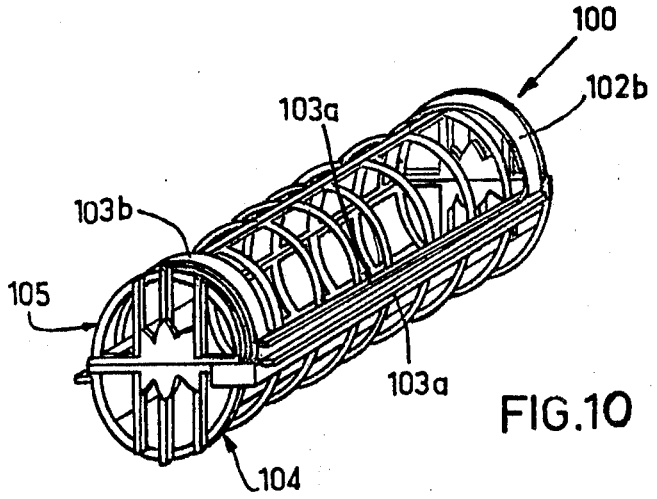
FIG. 10 represents in perspective a support according to the third embodiment of the second variation, the two hooks being in folded position for storage.
Figure 11:
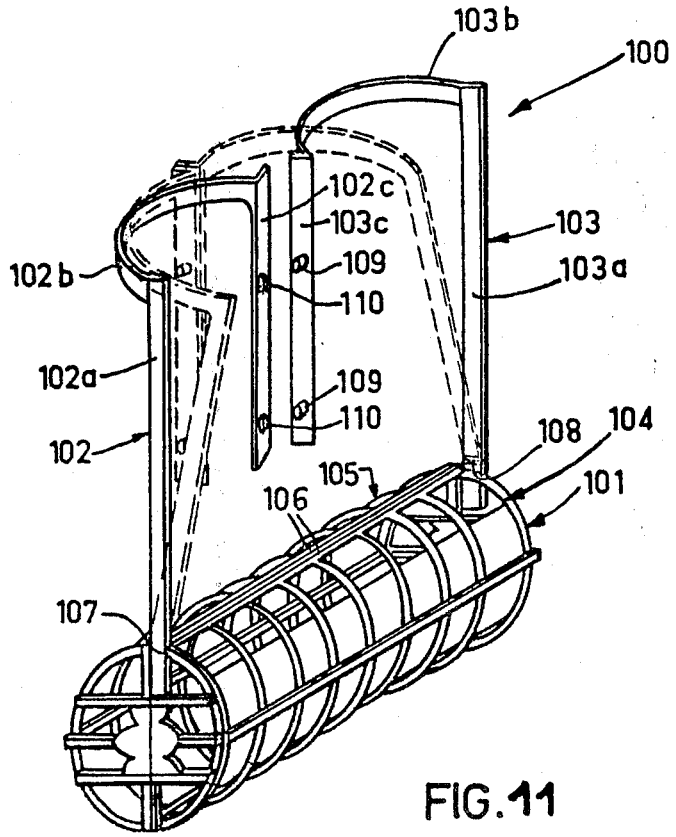
FIG. 11 represents in perspective the support of FIG. 10 in which the two hooks are in deployed position before snap fastening the extreme branches of the two hooks, the position after snap fastening and before putting in place on the edge of a toilet bowl being shown in broken lines.

Referring now to FIGS. 10 and 11, one sees that one has designated by 100, in its assembly, the one piece support serving to store a hydrosoluble bar which one desires to progressively dissolve in the flushing water of a toilet bowl in order to insure its disinfection and deodorization.

The support 100 consists of a basket 101 and two associated suspension hooks 102 and 103, said assembly being made in a single moulding step from polypropylene.

The cylindrical basket 101, inside which the bar of active product is lodged, is constituted by two concave members 104 and 105 having a semi-circular transverse section. The two concave members 104 and 105, as described in the principal patent, are perforated and pivotally connected to each other by means of connectors formed by moulding which are positioned between two longitudinal edges. At the closing of the basket 101 the solidarization of the two concave members is effectuated by snap fitting along their two longitudinal edges 106 which are diametrically opposed to those by which the pivotal attachment of the two concave members is effected. The two suspension hooks 102 and 103 are connected to the basket 101 by two ribs each formed on a transverse end of the concave member 104, each of these ribs being positioned in the vicinity of the corner which forms the intersection of the longitudinal edge 106 with one of the transverse edges of said concave member. The longer branches 102*a*, 103*a* of the two hooks are connected to the said ribs and each comprise a weakening 107, 108 formed in the wall and serving as a web hinge. Each of these web hinges is positioned in the vicinity of the zone at which the hooks are connected and project longitudinally with respect to the closed basket.

The two suspension hooks 102 and 103 pivot about their web hinge 107, 108 transversely with respect to the axis of the basket 101. Thus the two hooks may be unfolded and inversely folded against each other in a common direction like the two branches of a pair of spectacles.

The two hooks 102 and 103 terminate in a U shaped part constituted by the central curved branch 102*b*, 103*b* to the two ends of which are respectively connected the branches 102*a*, 102*c*, and 103*a*, 103*c*. The two central branches 102*b* and 103*b* have longitudinally a semi-circular profile and are extensible. Each end branch 102*c*, 103*c* is made in the shape of a plate which is connected at right angles to the central branch 102*b*, 103*b*. The support 100 having its two hooks in folded position (storage position) is represented on FIG. 1. The two branches 102*a* and 103*a* the length of which is substantially identical to that of the basket, are positioned on on the other against the two snap fitting edges 106 while the curved profiles 102*b* and 103*b* fit the circular contour of the basket and the two extreme branches 102*e* and 103*e* are substantially positioned in the zone of the pivotal axis of the two concave members which is diametrically opposed to the snap fitting edges 106. The support having two associated hooks then presents, in storage position, a bulk substantially equivalent to that given by the basket 101 alone.

Figure 2:
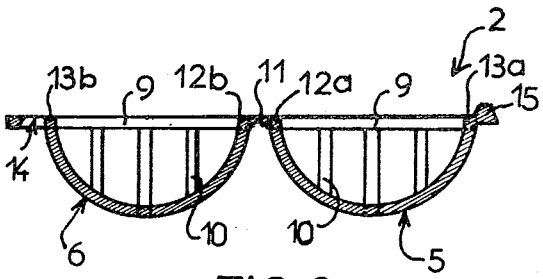
FIG. 2 represents a transverse section along the line II—II of FIG. 1.
Figure 3:
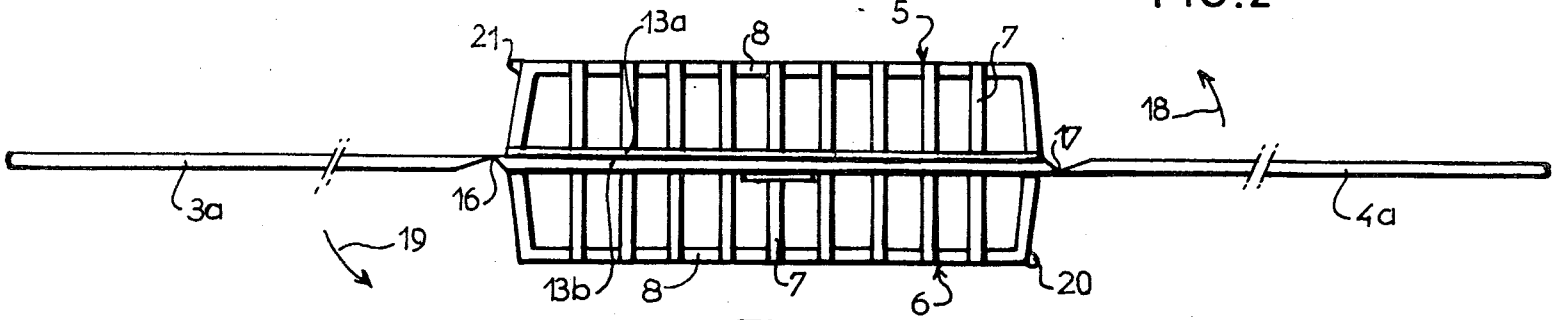
FIG. 3 represents a view in elevation of the basket of FIG. 1 after closing and before lifting of the suspension hooks.

On FIG. 2 one has represented the support at the moment of its use, that is to say with the two longest branches 102*a* and 103*a* disposed perpendicularly to the axis of the basket 101. The two hooks thus folded are substantially symmetrical with respect to the transverse median plane of the basket and their two longest branches are situated on opposite sides of the two extreme branches 102*c* and 103*c*. The essential particularity of this support is that the two extreme branches 102*c* and 103*c* may be attached to each other by snap fitting, the two hooks then taking the position represented in broken lines on FIG. 2. To this effect one provides two projections 109 formed on the face of the branch 103*c* which is turned toward the branch 102*c*. In the branch 102*c* are pierced two holes 110 inside which two corresponding projections 109 may be snapped. In order to insure the solidarization of the two extreme branches the two hooks occupying the position shown in solid lines on FIG. 2, the user brings them together to apply one against the other and snaps the projections 109 into the holes 110, the assembly plane of the two extreme snapped together branches being substantially disposed in the median transverse plane of the basket. In the course of this manoeuver, the two longer branches 102*a* and 103*a* are somewhat deformed and converge slightly in the direction of their end to which is connected the central branch 102*b*, 103*b*, respectively. To dispose the hooks thus connected by their extreme branches on the edge of a toilet bowl regardless of its thickness, the user separates the composite branch (102*c*–103*c*) of the two branches 102*a* and 103*a* by elastic deformation of the two curved profiles 102*b* and 103*b* and puts in place the two assembled hooks on the edge of the toilet bowl. The two central branches 102*b* and 103*b* forming a spring then tend to regain their original curved profile which permits them to grip the edge of the toilet bowl between the composite branch (102*c*–103*c*) on the one hand and the two branches 102*a* and 103*a* on the other hand. One finds that such an embodiment makes it possible to insure the effective maintenance of the support 100 without swinging under the flushing water of a toilet bowl.

I claim:

1. Support comprising a perforated basket forming a receptacle to contain a block of a hydrosoluble product for the disinfection and deodorization of toilet bowls, said basket comprising two substantially identical parts in the form of concave members pivotable to a closed position in contact with each other at their peripheral edge, one concave member pivoting with respect to the other concave member along an axis parallel to the axis of the basket by means of at least one integral connector formed by moulding with said concave members, said connector integrally uniting the two concave members at one of their longitudinal edges, fastener means for fastening the two concave members together at their other longitudinal edge to maintain the basket closed, at least one U shaped suspension hook fixed to the basket by a web hinge formed by moulding with said basket, a central branch of the U of the hook being elastically deformable and extensible and having a curved profile longitudinally so that said hook can elastically grip toilet bowl rims of different thickness, said at least one hook pivoting transversely with respect to the axis of said basket by means of said web hinge so that the branch of the U of the hook which is connected to the basket can swing to a position against and conforming to the lateral longitudinal surface of the basket after pivoting the concave members together to close the basket.

2. Support as claimed in claim 1 characterized by the fact that the basket is of generally cylindrical form, each of the concave members which constitute the basket being semi-circular in transverse section.

3. Support according to claim 1 characterized by the fact that the two concave members pivot with respect to each other by means of a plurality of integral web hinges regularly spaced over the entire length of the basket.

4. Support as claimed in claim 1 characterized by the fact that the fastener means comprise a projection positioned radially with respect to one concave member and comprising in its central zone a recess inside of which snap fastens a corresponding ridge formed in the longitudinal edge of the other concave member which is destined to bear against said projection upon closing the basket.

5. Support according to claim 4 further comprising a second suspension hook, web hinge means connecting said second hook a central branch of the U of the second hook being elastically deformable and extensible and having a curved profile longitudinally so that said second hook can elastically grip toilet bowl rims of different thickness to one of the two concave members.

6. Support according to claim 5 characterized by the fact that the two web hinges of the hooks are positioned at each end of the radial projection which constitutes the longitudinal edge of the concave member serving to assure the closure of the basket.

7. Support according to claim 5 characterized by the fact that the two hooks are capable of pivoting about their web hinge so that their two longer branches may fall against each other, substantially against the longitudinal edge of the concave member diametrically opposed to the edge along which the two concave members pivot, the central branch of the U of each hook then fitting the lateral longitudinal surface of a concave member after closure of the basket.

8. Support according to claim 5 characterized by the fact that the two extreme branches of the U of the hook which are not connected to the basket comprise means permitting them to be connected to each other after the two hooks have been unfolded.

9. Support as claimed in claim 8 characterized by the fact that the connecting of the extreme branches of the hooks is effectuated in a position in which the two central branches of the U of the hook have their concavities turned toward each other, the branches of the two hooks which are connected to the basket being disposed on opposite sides of the two extreme connected branches.

10. Support according to claim 9 characterized by the fact that the connecting of the two extreme branches of the U of the hook takes place by snap fitting.

11. Support according to claim 10 characterized by the fact that the two hooks of the support are identical, each extreme branch of the U of the hook being constituted by an elongated plate, the two plates being capable, by deformation of the central branch of each of the hooks of being applied one against the other along a connecting plane perpendicular to the axis of the basket to assure the connecting of the two extreme branches.

12. Support according to claim 10 wherein said snap fitting is constituted by at least one projection formed on the extreme branch of one of the hooks and at least one corresponding hole formed in the extreme branch of the other hook.

* * * * *